United States Patent [19]

Murata et al.

[11] Patent Number: 4,689,588

[45] Date of Patent: Aug. 25, 1987

[54] CIRCUIT BREAKER

[75] Inventors: Shiro Murata; Fumiyuki Hisatsune, both of Fukuyama, Japan

[73] Assignee: Mitsubishi Denki Kabushiki Kaisha, Tokyo, Japan

[21] Appl. No.: 881,258

[22] Filed: Jul. 2, 1986

[30] Foreign Application Priority Data

Jul. 2, 1985 [JP] Japan ..... 60-102007[U]
Jul. 2, 1985 [JP] Japan ..... 60-102008[U]

[51] Int. Cl.[4] ..... H01H 9/30

[52] U.S. Cl. ..... 335/201; 200/144 R; 200/147 R

[58] Field of Search ..... 200/144 R, 147 R; 335/201

[56] References Cited

U.S. PATENT DOCUMENTS 4,539,451 9/1985 Mori et al. ..... 200/144 R
4,628,163 12/1986 Mori et al. ..... 200/147 R

*Primary Examiner*—E. A. Goldberg
*Assistant Examiner*—Lincoln Donovan
*Attorney, Agent, or Firm*—Lowe, Price, Leblanc, Becker & Shur

[57] ABSTRACT

In a circuit breaker which has an arc runner (2) fixed on a curved fixed conductor (1), an upright part (11*b*) is formed in extended part of the fixing part (2B) of the arc runner (2); and the upright part (11*b*) works to retain the arc to prevent from excessive outward running of arc, and further, when made of ferromagnetic plate, also works to shield undesirable effect by magnetic field of power source side current on arc commutation from intercontact-point path to arc-runner path.

11 Claims, 6 Drawing Figures

CIRCUIT BREAKER

FIELD OF THE INVENTION AND RELATED ART STATEMENT

1. Field of the Invention

The present invention relates generally to a circuit breaker, and particularly to a circuit breaker having an arc extinguisher and an arc runner which is disposed on both sides of fixed contact point.

2. Description of the Related Art

In a circuit breaker of the field of this invention, prior art as shown in FIG. 3 and FIG. 3A is known. FIG. 3 is a partially sectional side view of the prior art circuit breaker described in the Japanese patent application No. Sho 59-169391 (Japanese unexamined published patent application No. Sho 61-49338), and FIG. 3A is a perspective view showing principal part of the prior art circuit breaker.

As shown in FIG. 3 and FIG. 3A, the circuit breaker of the prior art comprises a fixed conductor 1 having a fixed contact point 1A on one end thereof, an arc runner 2 fixed to the fixed conductor 1, a moving conductor 4 having a moving contact point 4A on moving end part, or in other words, near the moving end, of the moving conductor 4, and an arc extinguisher 5.

The fixed conductor 1 has a curved part 1*c* consisting of an intermediate part 11*a* and a rise up part 11*b*. The upper end of the rise up part 11*b* is integrally connected to a power source side lead 1*b*.

The fixed contact point 1A is electro-conductively fixed on an elevated holder part 1a of the fixed conductor 1. The elevated holder part 1*a* and the intermediate part 11*a* are formed integrally.

The arc runner 2 comprises a fixing part 2B, arc running part 2C and a folded part 2F connecting the above-mentioned two parts into integral body. The arc running part 2C has a slot 2*a* wherein the fixed contact point 1A is disposed. The fixing part 2B of the arc runner 2 is electro-conductively fixed to the intermediate part 11*a* of the fixed conductor 1 by a rivet 3, spot-welding, or the like means.

The moving conductor 4 is movably held by a known mechanism of circuit breaker at the opposite end part to the fixed contact point 4A, which touches to and parts from the fixed contact point 1A.

The arc extinguisher 5 comprises known plural deionization plates and is disposed in such a space S as being in front of moving course of the moving contact point 4A to carry out known arc extinguishing action.

The operation of the above-mentioned conventional circuit breaker is as follows. When the moving contact point 4A parts from the fixed contact point 1A, an arc is produced between two contact points 4A and 1A. As the opening of the contact points proceeds and distance of arc path between two contact points 1A and 4A becomes longer than the distance of arc path between the arc runner 2 and the end tip 4*c* of the moving conductor 4, the arc removes from the former arc path between the contact points to the latter arc runner path. Then, by means of known electromotive repulsion force induced by a current flowing through the arc runner 2, the arc is driven to the far end tip part 2*c* of the arc runner 2, and is cut into pieces by the deionizer plates of the arc extinguisher 5.

In the above-mentioned conventional circuit breaker, there was a problem that the arc was liable to over-run in a direction to the end tip part 2*c* of the arc runner 2, thereby to go out beyond the arc extinguisher 5. Such over-running of the arc out of the arc extinguisher 5 leads to lowering of circuit breaking ability.

Furthermore, the above-mentioned circuit breaker had a problem that, undesirable inverse arc-driving force in a direction of arrow C was induced by a stray magnetic flux induced by a current flowing in the direction of arrow B in the upright part 11*b*. And hence, intended quick shifting of the arc current from the arc path between the contact points 4*a* and 1*a* to the arc path between the arc runner 2 and the end tip 4*c* of the moving conductor 4 is obstracted, thereby lowering the circuit breaking ability.

OBJECT AND SUMMARY OF THE INVENTION

Accordingly, the present invention purposes to provide an improved circuit breaker capable of improving the circuit breaking ability.

In order to achieve the above-mentioned object, the circuit breaker in accordance with the present invention adopts the configuration that comprises:

- a fixed conductor connected by one end to power source side and having curved part,
- a fixed contact point provided on the other end of the fixed conductor at a side inner with respect to curving of the curved part,
- an arc runner which is a conductor having a fixing part, which is electro-conductively fixed to an intermediate part of the fixed conductor, an arc running part, which has a slot wherein the fixed contact point is disposed, and a folded part, which is connecting the fixing part and the arc running part making an acute angle therebetween, and
- a moving conductor having a moving contact point on its moving and part, wherein improvement is that

- a rise up member which is a conductor having a fixing part, which is electro-conductively fixed to the intermediate part, and a rise up part, which rises up extending substantially in perpendicular direction with respect to the intermediate part in a manner that end tip thereof is disposed at a position beyond an end tip of the arc running part with a given air gap therebetween.

Furthermore, in order to achieve more improved circuit breaking ability, the above-mentioned rise up member is made of a ferromagnetic substance, so as to magnetically shield space of arc running from power source side part of the fixed conductor which is disposed behind the rise up member.

DESCRIPTION OF THE PREFERRED EMBODIMENTS

Figure 1:
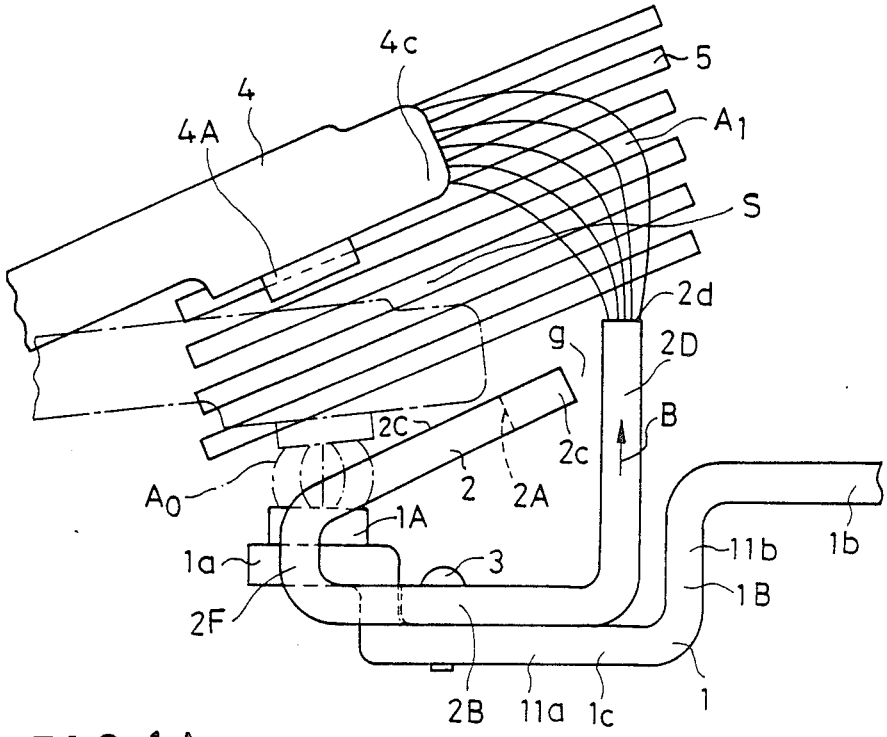
FIG. 1 is a partly sectional side view of a principal part of a circuit breaker embodying the present invention.
Figure 1A:
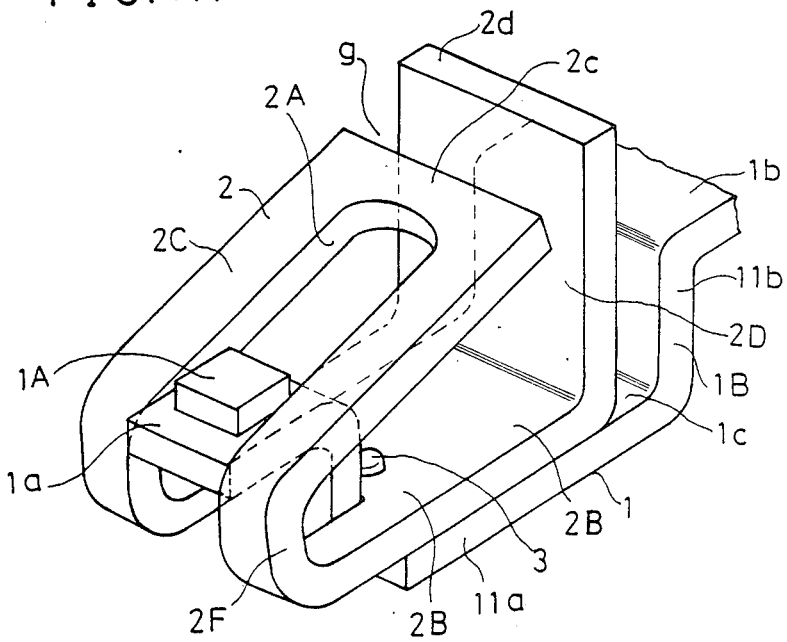
FIG. 1A is a perspective view of an essential part of the embodiment of FIG. 1.

FIG. 1 and FIG. 1A show a principal part of a first embodiment of the present invention. As shown in the drawings, the circuit breaker of the first embodiment comprises a fixed conductor 1 having a contact point 1A on one end thereof, an arc runner 2 fixed to the fixed conductor 1, a moving conductor 4 having a moving contact point 4A on moving end part, or in other word near the moving end, of the moving conductor 4, and an arc extinguisher 5. Furthermore, the circuit breaker in accordance with the present invention comprises a rise up member 2D, which is made of conductive substance, such as copper or iron, and the rise up member 2D is electro-conductively connected to the fixed conductor 1 by rivetting or spot-welding or the like means.

The fixed conductor has a curved part 1*c* consisting of an intermediate part 11*a* and a rise up part 11*b*. The upper end of the rise up part 11*b* is integrally connected to power source side lead 1*b*.

The fixed contact point 1A is electro-conductively fixed on an elevated holder part 1a of the fixed conductor 1. The elevated holder part 1*a* and the intermediate part 11*a* are made integrally.

The arc runner 2 comprises a fixing part 2B, arc running part 2C and a folded part 2F connecting the above-mentioned two parts into integral body. The arc running part 2C has a slot 2*a* wherein the fixed contact point 1A is disposed. The fixing part 2B of the arc runner 2 is electro-conductively fixed to the intermediate part 11*a* of the fixed conductor 1 by a rivet 3, spot-welding, or the like means.

The rise up member 2D may be configurated integral to the arc runner 2 by extending the fixing part 2B and folding it upward to form the rise up part 2D, as shown in the example of FIG. 1 and FIG. 1A. In such configuration, the rivet 3 or spot-welding means is for fixing the fixing part 2B of the arc runner 2 to the intermediate part 11*a* of the fixed conductor 1. The above-mentioned rise up member 2D constitute an arc retainer for retaining the arc there, thereby to prevent the arc from running excessively outside beyond the arc extinguisher 5.

The moving conductor 4 is movably held by a known mechanism of circuit breaker at the opposite end part to the fixed contact point 4A, which touches to and parts from the fixed contact point 1A to break and connect circuit.

The arc extinguisher 5 comprises known plural deionization plates and is disposed in such a space S as is in front of moving path of the moving contact point 4A to carry out known arc extinguishing action.

The operation of the above-mentioned conventional circuit breaker is as follows. When the moving contact point 4A parts from the fixed contact point 1A, an arc $A_O$ is produced between two contact points 4A and 1A. As the opening action of the contact points proceeds and distance of arc path between two contact points 1A and 4A becomes longer than the distance of arc path between the arc runner 2 and the end tip 4*c* of the moving conductor 4, the arc removes from the former arc path (which is between the contact points) to the latter arc path. Then, by means of electromotive repulsion force induced by a current flowing through the arc runner 2, the arc is driven to the far end tip part 2*c* of the arc runner 2, and is cut into many pieces by the deionizer plates of the arc extinguisher 5.

Since the rise up member 2D of the conductive substance such as copper or iron is provided, being connected to the fixed conductor 1, the rise up member 2D serves as the arc retainer. Since the top face of the rise up member 2D has a substantially horizontal face 2*d*, the arc A which runs rightwards from the fixed contact point 1A on the arc runner part 2C finally jumped on the top face 2*d* of this arc retainer 2D, thereby forming the retention arc $A_1$ as shown by the solid lines. Accordingly, undesirable excessive arc running to the end tip 2*c* of the arc runner 2C and subsequent shifting of the power source side lead 1*b*, which has been hitherto observed, is prevented. Hence, satisfactory arc extinguishing by the arc extinguisher 5 is achievable. In order to make effective commutation of the arc from the end part 2*c* of the arc runner 2 to the top edge face 2*d* of the arc retainer 2D, the arc retainer 2D is preferably configurated such that the top edge 2*d* protrudes above a virtual plane which is an extension of upper surface (arc running surface) near end part 2*c* of the arc running part 2C.

Figure 3:
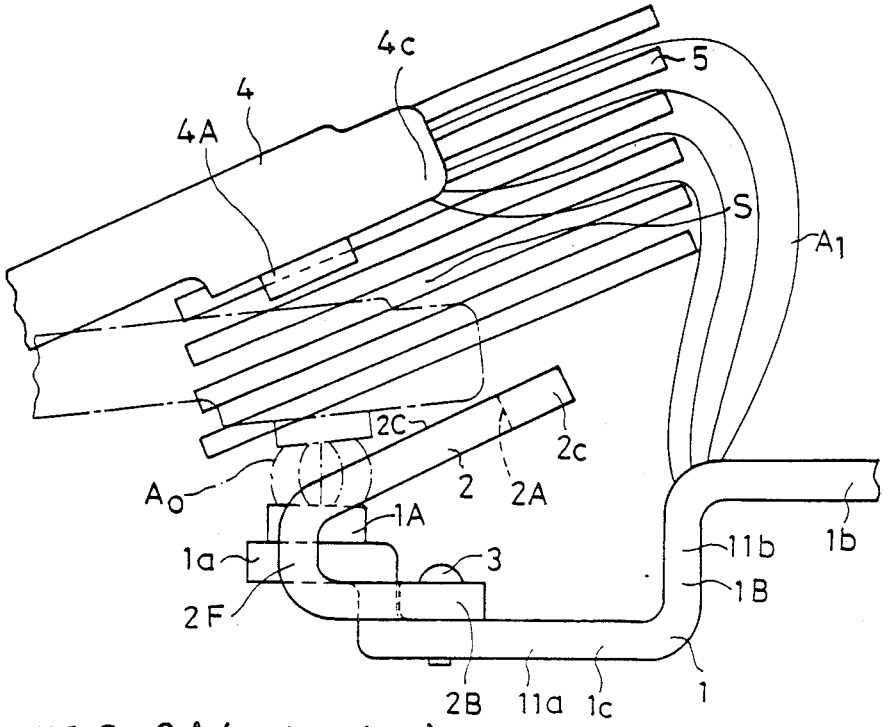
FIG. 3 (Prior Art)
FIG. 3 is the partially sectional side view of principal part of the conventional circuit breaker.
Figure 3A:
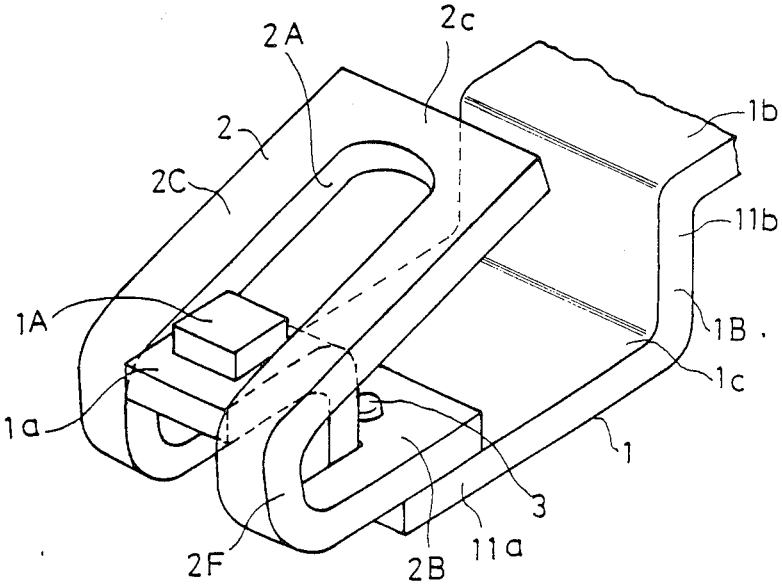
FIG. 3A (Prior Art)
FIG. 3A is the perspective view of the essential part of the conventional circuit breaker of FIG. 3.

The aforementioned problem of the prior art that undesirable inverse arc-driving force in a direction of arrow C (FIG. 3) is induced by a current flowing in the direction of arrow B (FIG. 3) in the upright part 11*b*, hence obstructing quick shifting of the arc current from the arc path between the contact points 4*a* and 1*a* to the arc path between the arc runner 2 and the end tip 4*c*, can be effectively dissolved by making the rise up member 2D, which is provided in front of the upright part 11*b*, by using a ferromagnetic substance, such as iron plate or the suitable magnetic alloy. By making the rise up part 2D made of the ferromagnetic substance, the undesirable electromagnetic effect by a large current, which flows in the upright part 11*b* from the power source side 1*b* to the fixed contact point 1A, can be shielded. Therefore, no undesirable electromagnetic effect is given to the arc $A_0$ which is between the fixed contact point 1A and the moving contact point 4A at the initial state of opening of the moving conductor 4. Accordingly, the arc $A_0$ can be smoothly commuted from the arc path between the fixed contact point 1A and the moving contact point 4A to the runner arc path between the runner part 2C and end tip part 4*c*. And thereby, circuit breaking characteristic of the circuit breaker is satisfactorily improved.

That is, the ferromagnetic shield 2D can be served simultaneously as the arc retainer, and also as the magnetic shield, when it is made of a ferromagnetic substance. When the magnetic shield 2D is disposed in close proximity to the upright part 11*b*, the effect of magnetic shield becomes prominent. As shown in FIG. 1, FIG. 1A, FIG. 2 and FIG. 2A, by forming the magnetic shield 2D in integral configulation with the arc runner 2, the effect of the arc retainer and the magnetic shield is obtainable, only by slight addition of the rise up member 2D to the fixing part 2B of the arc runner 2, and its manufacturing is easy and economical.

Figure 2:
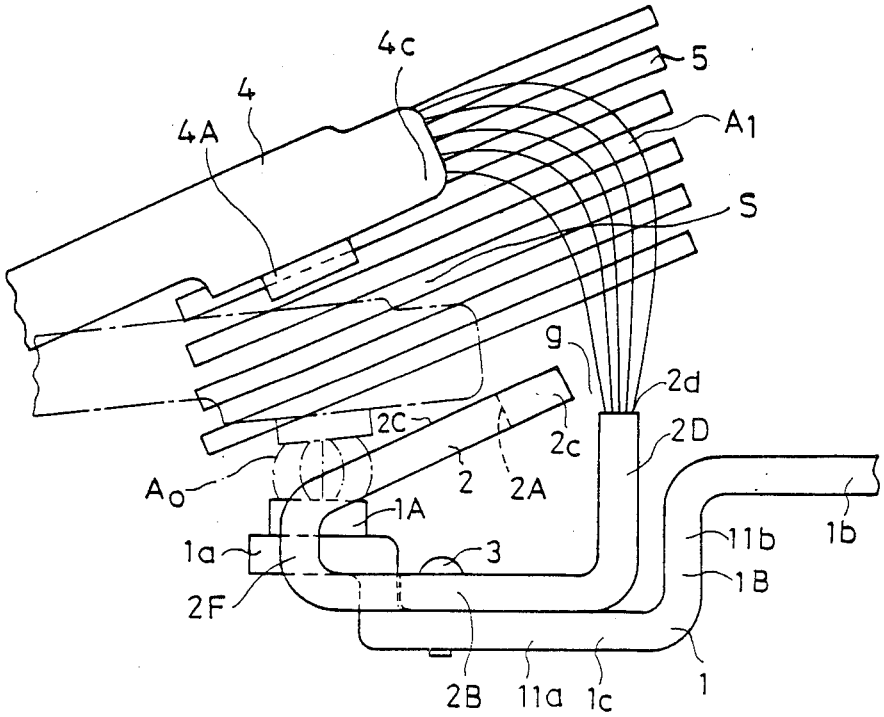
FIG. 2 is a partial sectional view of principal part of another embodiment of circuit breaker in accordance with the present invention.
Figure 2A:
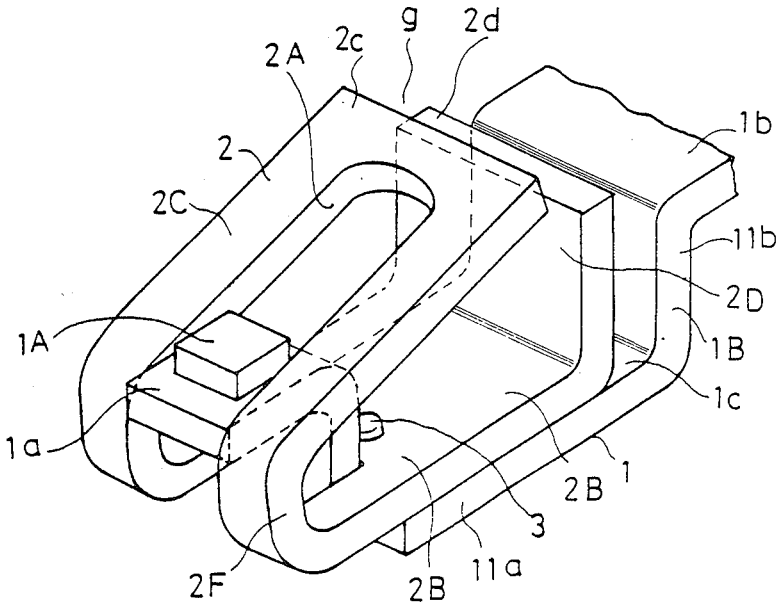
FIG. 2A is a perspective view of an essential part of the embodiment of FIG. 2.

In order to achieve prominent effect of stable arc commutation from the arc runner part 2C to the arc retainer 2D, the position of the top face 2*d*, of the rise up member 2D should be protruding above the virtual plane of extension of the runner part 2C; whereas when the effect of the magnetic shield is mainly required, the top face 2*d* of the rise up part 2D may be offset from the virtual plane as shown in FIG. 2 and FIG. 2A.

In the above-mentioned embodiments shown in FIG. 1, FIG. 1A, FIG. 2 and FIG. 2A, the rise up member 2D is made by continuously extending the fixing part 2B of the arc runner 2 and uprightly bending its end to form the rise up member 2D. But the rise up member 2D may be produced as a separate piece from the arc runner 2 by separately rivetting or spot-welding it onto the fixed conductor 1.

What is claimed is:

1. A circuit breaker comprising:

a fixed conductor connected by one end to power source side, a fixed contact point provided on the other end of said fixed conductor, an arc runner which is a conductor having a fixing part, which is electro-conductively fixed to an intermediate part of said fixed conductor, an arc running part, which has a slot wherein said fixed contact point is disposed, and a folded part, which is connecting said fixing part and said arc running part making an acute angle therebetween, and a moving conductor having a moving conductive contact arm having a fixed contact at its free end, wherein improvement is that a rise up member which is a conductor having a fixing part, which is electro-conductively fixed to said intermediate part, and a rise up part, which rises up extending substantially in perpendicular direction with respect to said intermediate part in a manner that the end tip thereof is disposed at a position beyond an end tip of said arc running part with a given air gap therebetween.

2. A circuit breaker in accordance with claim 1, wherein said rise up member has an end face which is in a direction substantially facing an end tip of said moving conductor at opening motion, to retain arc between said end face and said end tip at said opening motion.

3. A circuit breaker in accordance with claim 2, wherein said end face is disposed to protrude above a virtual plane which is an extension of surface near end part of said arc running part.

4. A circuit breaker in accordance with claim 1, wherein said rise up member is of ferromagnetic substance, to magnetically shield space of arc running from an upright part of power source side part of said fixed conductor, which is disposed behind said rise up member.

5. A circuit breaker in accordance with claim 4, wherein said rise up member is disposed in close vicinity to said upright part of said power source side part.

6. A circuit breaker in accordance with claim 1, wherein said rise up member is constituted instegrally to said arc runner by forming said fixing parts of both member continously.

7. A circuit breaker in accordance with claim 6, wherein said rise up member has an end face which is in a direction substantially facing an end tip of said moving conductor at opening motion, to retain arc between said end face and said end tip at said opening motion.

8. A circuit breaker in accordance with claim 6, wherein said end face is disposed to protrude above a virtual plane which is an extension of surface near end part of said arc running part.

9. A circuit breaker in accordance with claim 6, wherein said rise up member is of ferromagnetic substance, to magnetically shield space of arc running from an upright part of power source side part of said fixed conductor, which is disposed behind said rise up member.

10. A circuit breaker in accordance with claim 6, wherein said rise up member is disposed in close vicinity to said upright part of power source side part.

11. A circuit breaker in accordance with claim 1, wherein said fixed conductor has a curved part and said fixed contact point is provided at a side inner with respect to curving of said curved part.

* * * * *